US010361519B2

(12) United States Patent
Chuang

(10) Patent No.: US 10,361,519 B2
(45) Date of Patent: Jul. 23, 2019

(54) BOARD TO BOARD CONNECTOR ASSEMBLY WITH SANDWICHING TYPE SHIELDING PLATE SET

(71) Applicant: FOXCONN INTERCONNECT TECHNOLOGY LIMITED, Grand Cayman (KY)

(72) Inventor: Shun-Jung Chuang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/854,833

(22) Filed: Dec. 27, 2017

(65) Prior Publication Data

US 2018/0183189 A1 Jun. 28, 2018

(30) Foreign Application Priority Data

Dec. 28, 2016 (CN) ..... 2016 1 1237266

(51) Int. Cl.

| | |
|---|---|
| ***H01R 12/00*** | (2006.01) |
| ***H01R 13/6585*** | (2011.01) |
| ***H01R 13/41*** | (2006.01) |
| *H01R 12/71* | (2011.01) |

(52) U.S. Cl.

CPC ..... *H01R 13/6585* (2013.01); *H01R 13/41* (2013.01); *H01R 12/716* (2013.01)

(58) Field of Classification Search

CPC .... H01R 13/6594; H01R 12/52; H01R 13/41; H01R 12/716

USPC ..... 439/607.36, 607.05, 607.08, 74

See application file for complete search history.

(56) References Cited

U.S. PATENT DOCUMENTS

| | | | | |
|---|---|---|---|---|
| 5,542,851 | A * | 8/1996 | Chikano | H01R 13/6582 439/108 |
| 5,813,871 | A * | 9/1998 | Grabbe | H01R 23/688 439/108 |
| 5,904,581 | A * | 5/1999 | Pope | H01R 12/716 439/74 |
| 6,077,121 | A * | 6/2000 | Wu | H01R 12/712 439/607.05 |
| 6,250,935 | B1 * | 6/2001 | Mochizuki | H01R 13/658 439/74 |

(Continued)

FOREIGN PATENT DOCUMENTS

CN 201072831 Y 6/2008

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

The receptacle connector includes an insulative housing, a plurality of contacts retained in the housing, and a metallic shielding shell covering the housing. The housing includes a base and an island extending upwardly from the base, and a peripheral wall surrounding the island and forming a tubular receiving cavity. The contacts includes two rows of contacts retained to the island. The shielding shell is retained to the peripheral wall. A pair of metallic shielding plates are retained in the island and between two rows of contacts. The plug connector includes an insulartive housing, a plurality of contacts retained to the housing, and a metallic shielding shell attached upon the housing. The housing includes a base and a circumferential wall forming a mating cavity. A metallic shielding plate is disposed in the mating cavity.

18 Claims, 8 Drawing Sheets

(56) References Cited

U.S. PATENT DOCUMENTS 6,503,101 B1 * 1/2003 Yu ..... H01R 13/6597 439/607.36
6,884,094 B1 * 4/2005 Bernhart ..... H01R 13/28 439/101
7,632,107 B2 * 12/2009 Mizumura ..... H01R 23/68 439/108
8,888,506 B2 * 11/2014 Nishimura ..... H01R 12/7082 439/74
8,986,027 B2 * 3/2015 Nishimura ..... H01R 12/707 439/181
9,246,279 B2 * 1/2016 Kato ..... H01R 13/6596
2005/0032400 A1 * 2/2005 Zhang ..... H01R 13/41 439/74
2005/0042924 A1 * 2/2005 Zhang ..... H01R 13/6582 439/607.36
2006/0063432 A1 * 3/2006 Chen ..... H01R 13/658 439/607.36
2006/0276061 A1 * 12/2006 Koguchi ..... H01R 12/725 439/74
2008/0207014 A1 * 8/2008 Takeuchi ..... H01R 13/6275 439/74
2008/0305657 A1 * 12/2008 Midorikawa ..... H01R 4/028 439/74
2009/0061655 A1 * 3/2009 Miyazaki ..... H01R 12/57 439/74
2010/0068900 A1 * 3/2010 Wu ..... H01R 12/716 439/74
2011/0092096 A1 * 4/2011 Jin ..... H01R 12/712 439/607.05
2011/0263140 A1 * 10/2011 Sato ..... H01R 12/7052 439/74
2013/0012039 A1 * 1/2013 Nose ..... H01R 12/716 439/74
2014/0273629 A1 * 9/2014 Canning ..... H01R 24/28 439/607.36
2015/0079816 A1 * 3/2015 Suzuki ..... H01R 12/716 439/74
2015/0140840 A1 * 5/2015 Nishimura ..... H01R 12/79 439/74
2015/0140841 A1 * 5/2015 Watanabe ..... H01R 12/7011 439/74
2015/0207248 A1 * 7/2015 Takenaga ..... H01R 12/716 439/74
2016/0190719 A1 * 6/2016 Brzezinski ..... H01R 12/73 439/74

* cited by examiner

BOARD TO BOARD CONNECTOR ASSEMBLY WITH SANDWICHING TYPE SHIELDING PLATE SET

FIELD OF THE DISCLOSURE

The invention is related to an electrical connector assembly, and particularly to the board-to-board connector with sandwiching type shielding plate set.

DESCRIPTION OF RELATED ARTS

China Utility Patent No. CN201072831Y discloses a board-to-board connector having an insulative housing with two rows of contacts and a metallic shell enclosing the housing. The housing includes a base and an island extending from the base, on which two rows of the contacts are exposed, wherein a circumferential mating groove surrounds the island. Anyhow, an Electro-Magnetic Interference (EMI) may occur between two rows of contacts.

An electrical connector with not only the exterior shield and the interior shield is desired.

SUMMARY OF THE DISCLOSURE

An electrical board-to-board connector assembly includes a receptacle connector and a plug connector mated with each other. The receptacle connector includes an insulative housing, a plurality of contacts retained in the housing, and a metallic shielding shell covering the housing. The housing includes a base and an island extending upwardly from the base, and a peripheral wall surrounding the island and forming a tubular receiving cavity. The contacts includes two rows of contacts retained to the island. The shielding shell is retained to the peripheral wall. A pair of metallic shielding plates are retained in the island and between two rows of contacts. The plug connector includes an insulartive housing, a plurality of contacts retained to the housing, and the shielding shell attached upon the housing. The housing includes a base and a circumferential wall forming a mating cavity. A metallic shielding plate is disposed in the mating cavity. During mating, the circumferential wall is received within the tubular receiving cavity, and the island is received within the mating cavity so as to have the shielding blade of the plug connector is sandwiched between the pair of shielding plates.

DETAILED DESCRIPTION OF THE PREFERRED EMBODIMENT

Figure 1:
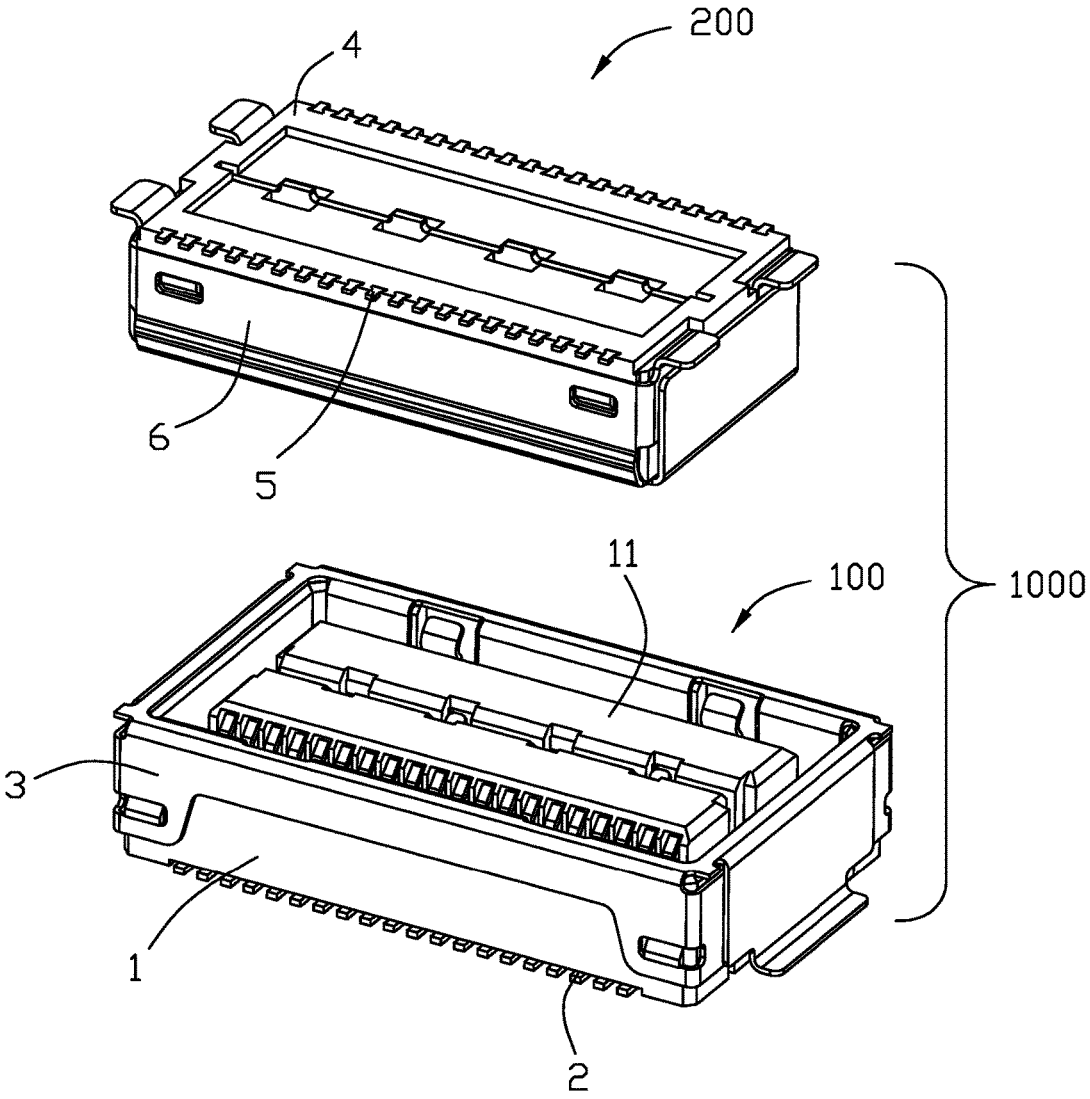
FIG. 1 is a perspective view of the electrical connector assembly of the invention including the mated receptacle connector and plug connector.
Figure 2:
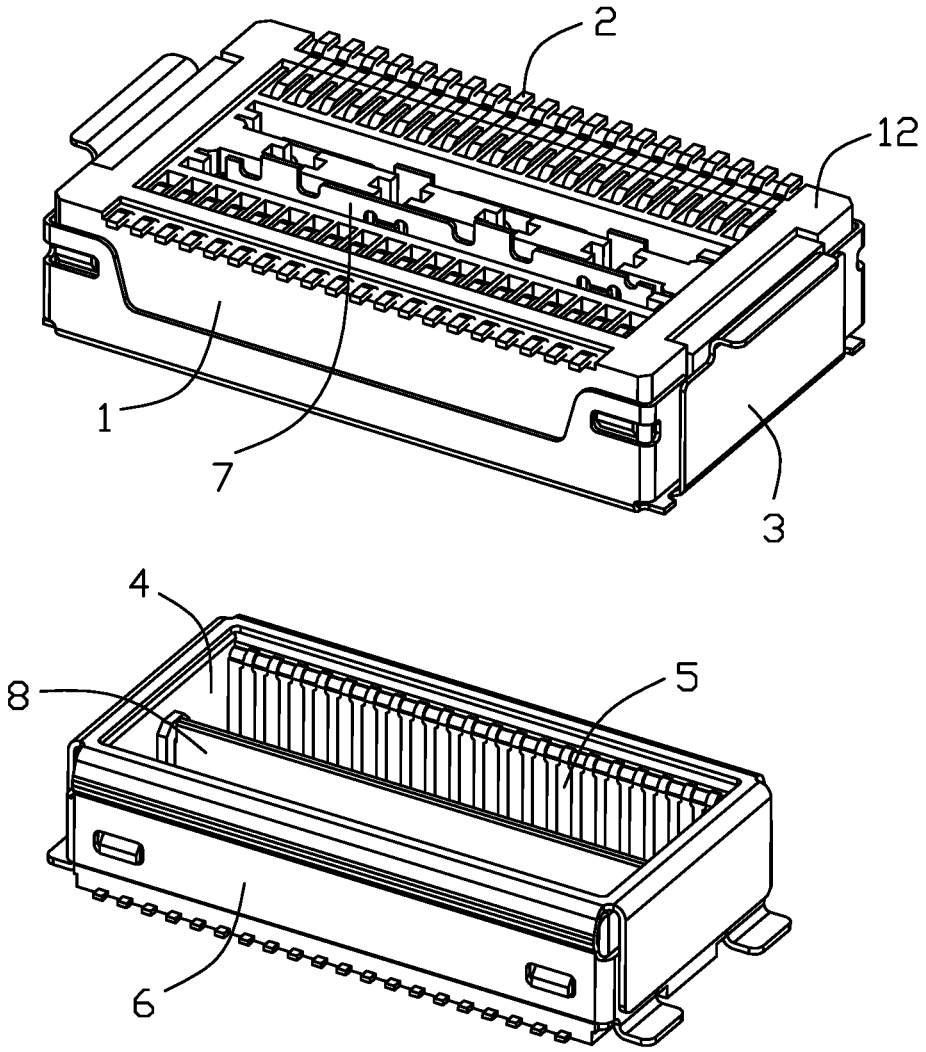
FIG. 2 is another perspective view of the electrical connector assembly of FIG. 1.

Reference will now be made in detail to the embodiments of the present disclosure. Referring to FIGS. 1-8, an electrical connector assembly 1000 is essentially a board-to-board connector set including a receptacle connector 100 mounted upon one printed circuit board (not shown), and a plug connector 200 mounted upon another printed circuit board (not shown). The receptacle connector 100 includes an insulative housing 1, a plurality of contacts 2 retained to the housing 1, and a metallic shield 3 covering the housing 1. The plug connector 200 includes an insulative casing 4, a plurality of terminals 5 retained to the casing, and a metallic shell 6 enclosing the casing 4.

Figure 7:
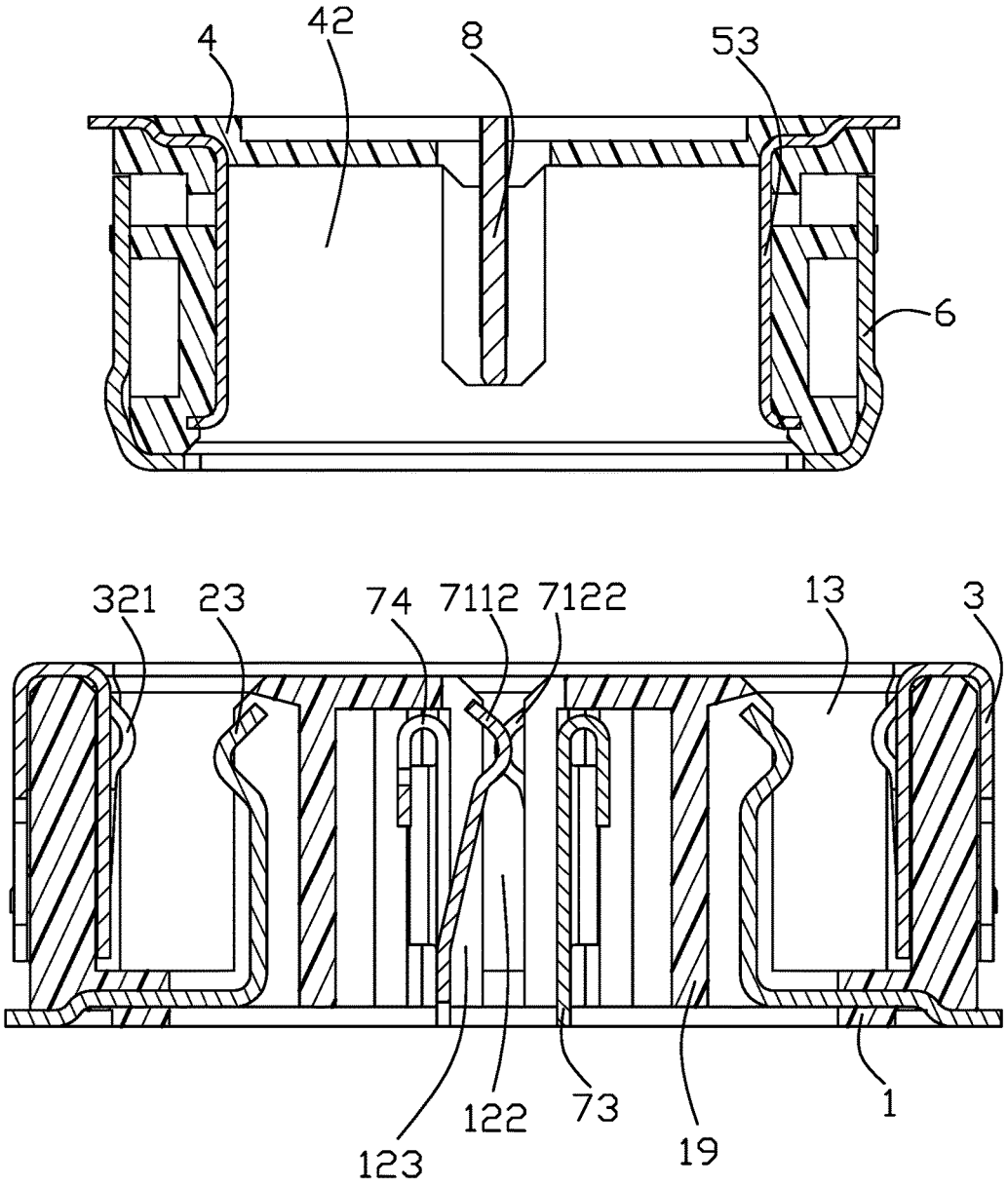
FIG. 7 is a cross-sectional view of the electrical connector assembly of FIG. 1 wherein the receptacle connector and the plug connector are unmated with each other.
Figure 8:
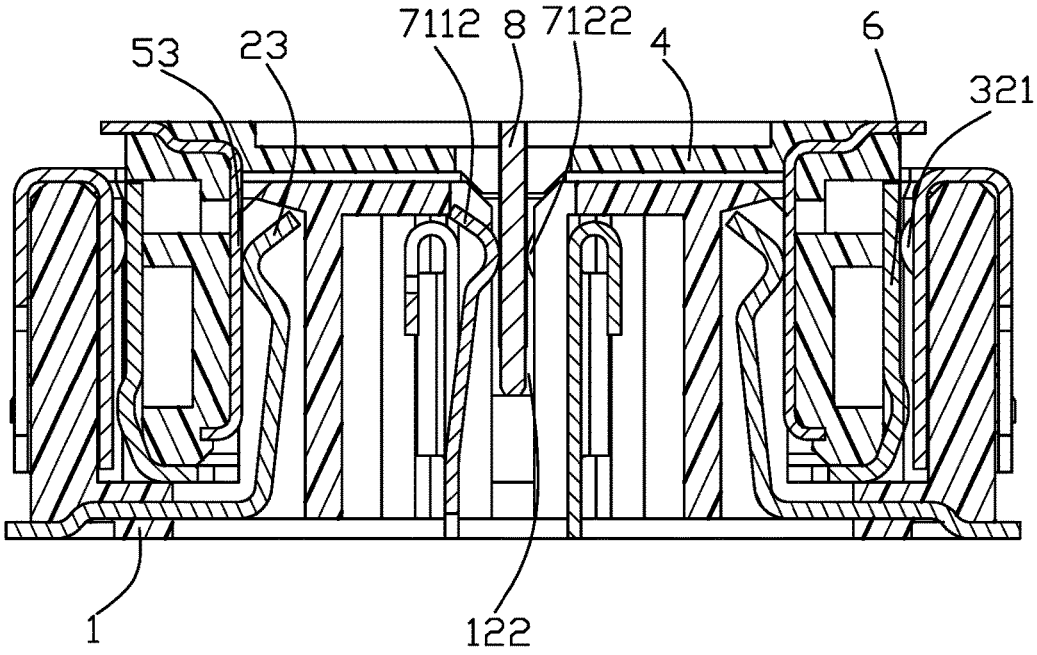
FIG. 8 is a cross-sectional view of the electrical connector assembly of FIG. 1 wherein the receptacle connector and the plug connector are mated with each other.

In the receptacle connector 100, the housing 1 includes a base 11 and an island 12 extending from the base 11, and a peripheral wall 14 surrounding the island 12 to form a tubular receiving cavity 13 therebetween. The contacts 2 are arrange with two rows. The peripheral wall 14 includes a pair of long side walls 141 and a pair of short side walls 142. The shield 3 covers both the side walls 141 and the side walls 14 continuously. The shield 3 further includes the inner part 32 extending from the outer part 31 and covering the interior face 1411 of the first side wall 141 with a plurality of spring tangs 321 extending into the tubular receiving cavity 13. The two rows of contacts 2 are respectively disposed upon two opposite sides of the island 12 directing to the corresponding long side walls 141. Each contact 2 includes a retaining section 21, a soldering section 23 extending from the retaining section 21 an exposed outside of the long side wall 141, and a resilient contacting section 23 extending from the retaining section 21 and exposed upon the island 12 and extending into the tubular receiving cavity 13. The shield 3 further includes a pair of soldering legs 33 by two short side walls 142. The long side wall 141 forms blocks 1411 engaged within the holes 311 of the shield 3. As shown in FIG. 7, the spring tangs 321 communicatively and directly face toward and opposite to the contacting sections 23 of the contacts along the transverse direction in the receiving cavity 13.

In the plug connector 200, the insulative casing 4 includes a base 41 and a circumferential wall 43 extending upwardly from the base 41 to form a mating cavity 42. The terminals 5 are arranged with two rows. The casing includes a pair of large walls 431 and a pair of small walls 432. The shell 6 forms holes 61 to receive the corresponding blocks 4311 formed on the large side wall 431 for securing the shell 6 to the casing 4. The terminals 5 includes a retaining portion 51 retained to the casing 4, a soldering portion 52 extending from the retaining portion 51 and outside of the large side wall 431, and a planar contacting portion 53 extending from the retaining portion 51 and exposed upon the an interior surface of the large side wall 431. The shell 6 further includes a pair of soldering pads 62 by two sides of the small side walls 421.

Notably, during mating the island 12 is inserted into the mating cavity 42 and the circumferential wall 43 is received within the tubular receiving cavity 13. The contacting sections 23 connect to the corresponding contacting portions 53. The spring tangs 321 abut against the shell 6. The shielding effect is perfected due to the continuous surrounding/shielding structure on each connector.

Figure 3:
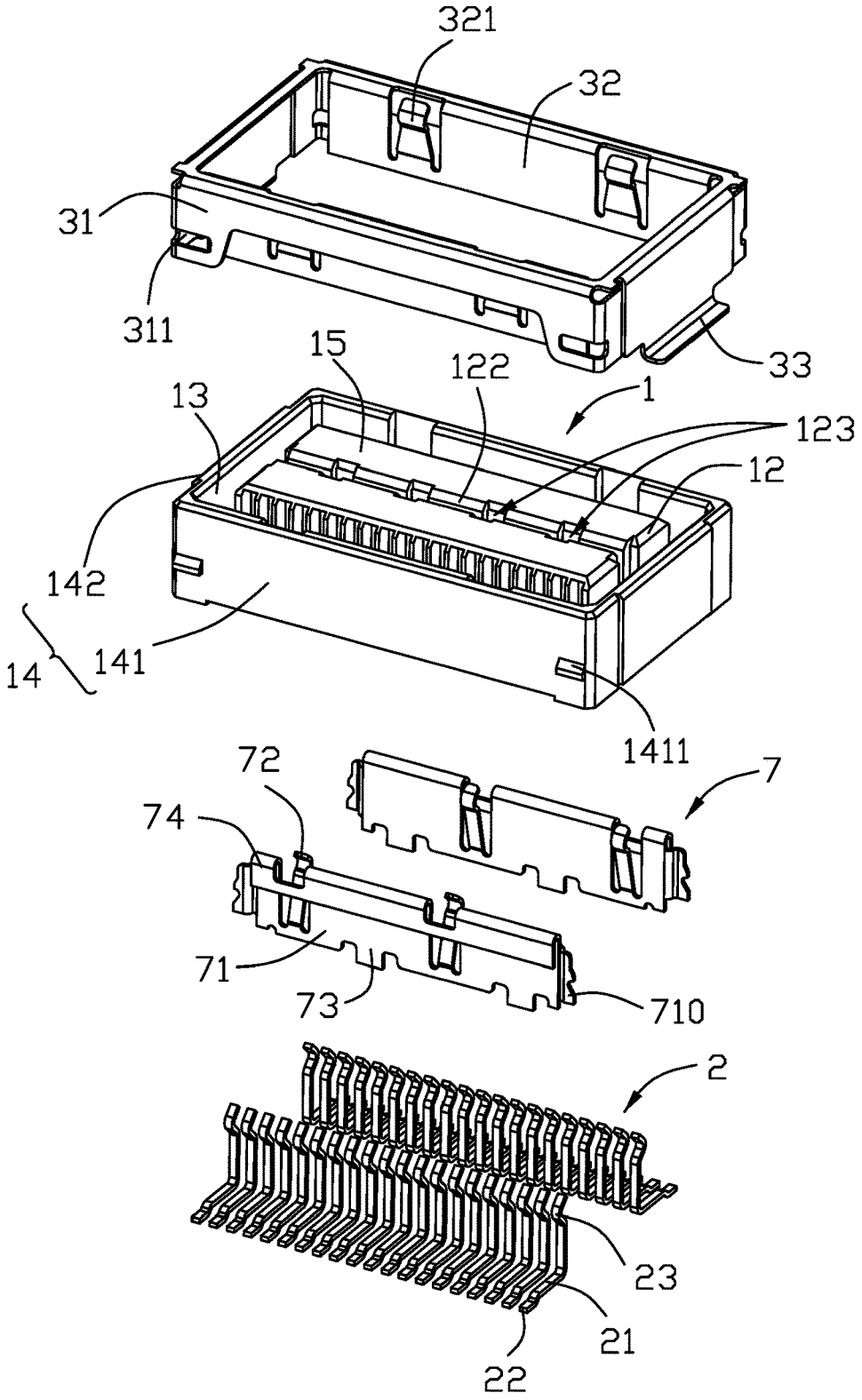
FIG. 3 is an exploded perspective view of the receptacle electrical connector of the electrical connector assembly of FIG. 1.
Figure 4:
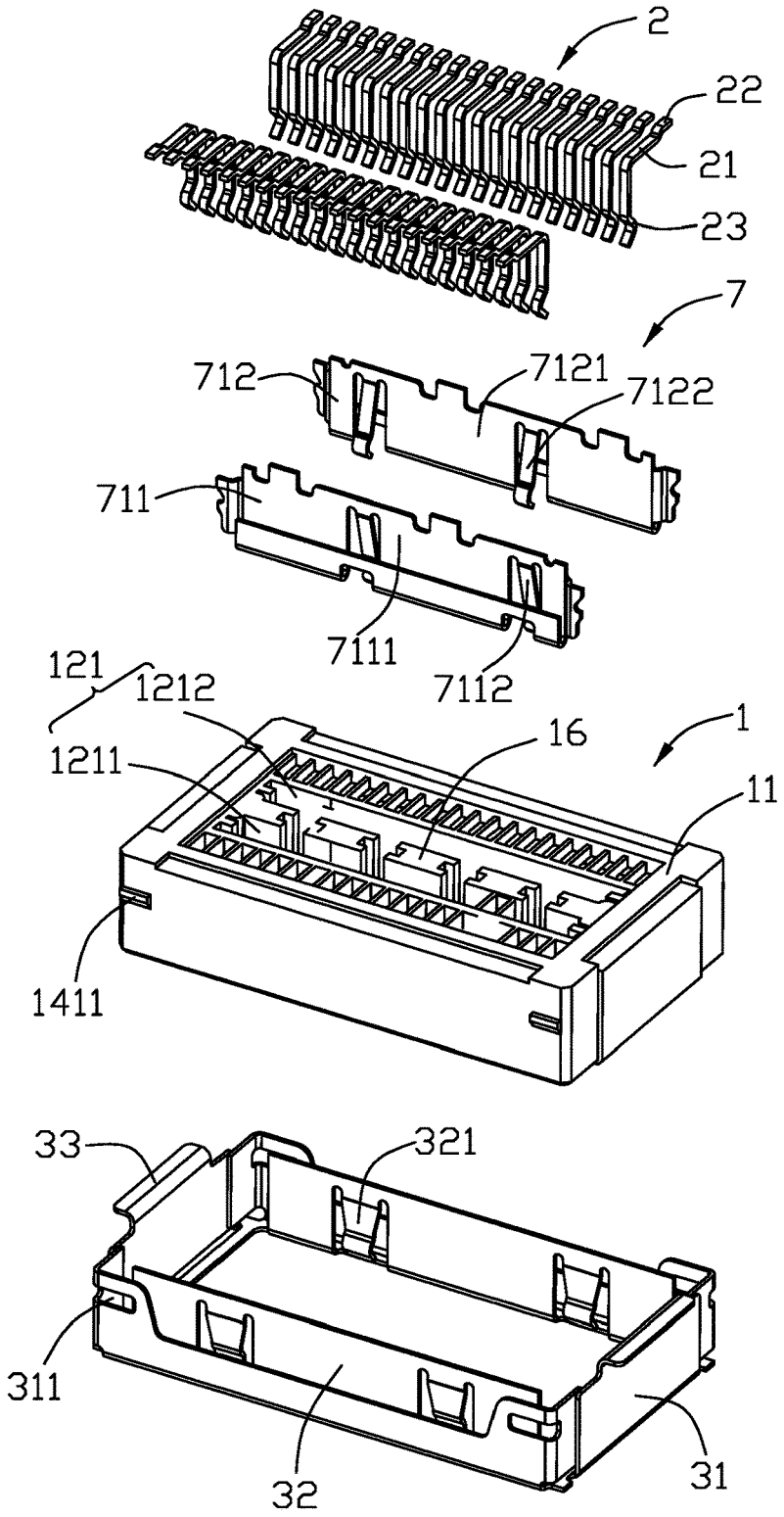
FIG. 4 is another exploded perspective view of the receptacle electrical connector of FIG. 3.
Figure 5:
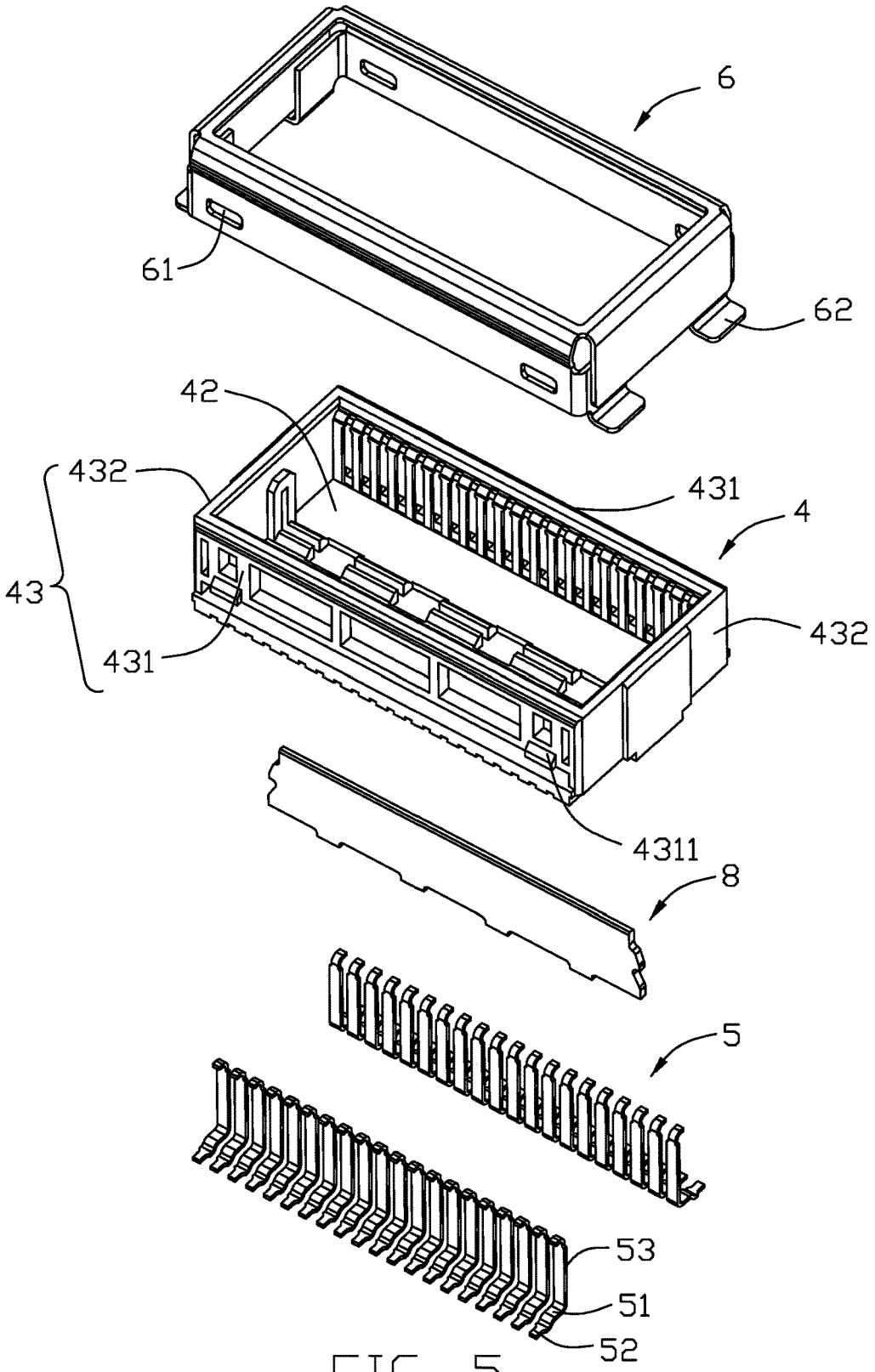
FIG. 5 is an exploded perspective view of the plug connector of the electrical connector assembly of FIG. 1.
Figure 6:
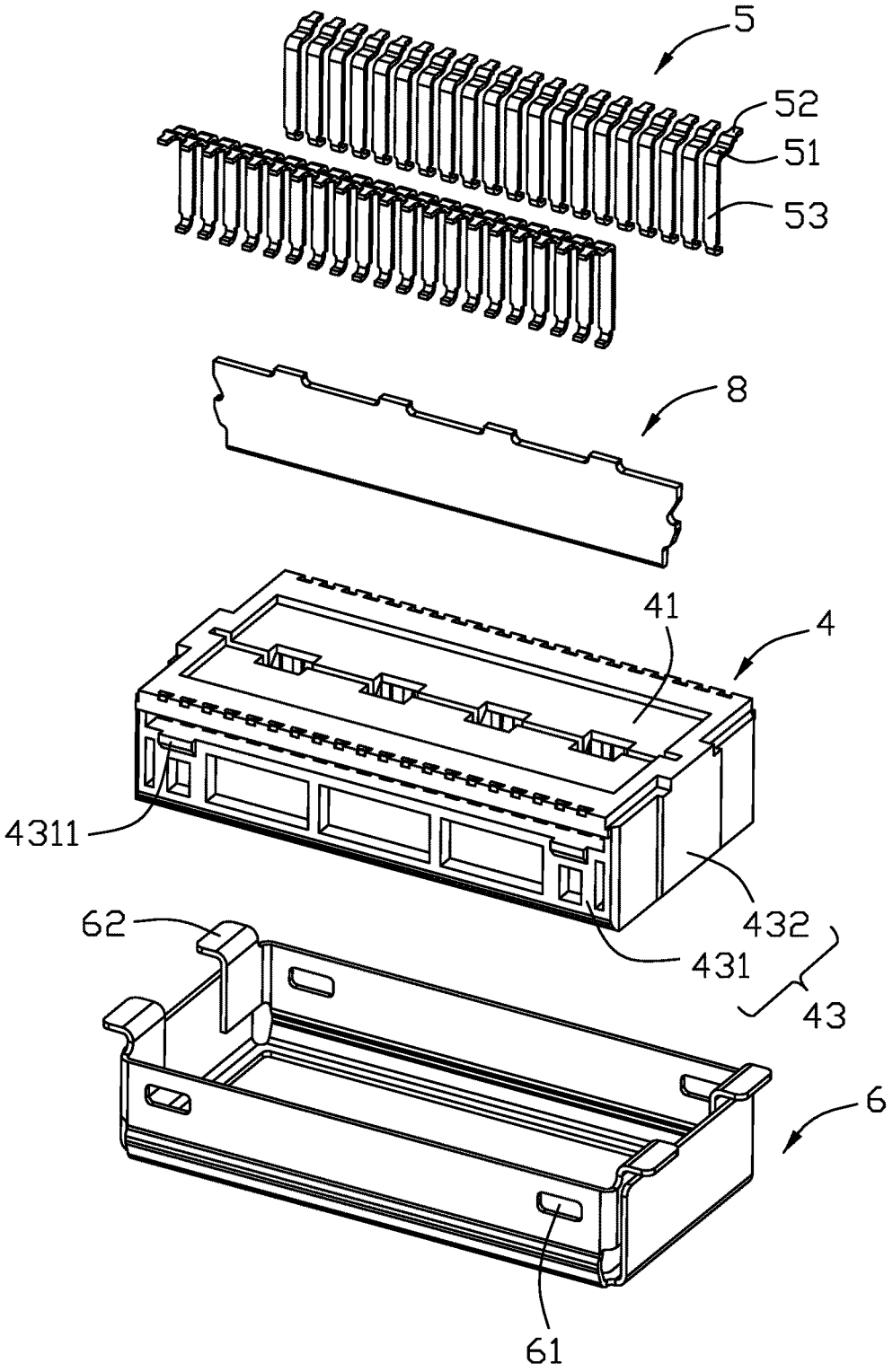
FIG. 6 is another exploded perspective view of the plug connector of FIG. 5.

The feature of the invention is to provide the anti-EMI structures between the receptacle connector 100 and the plug connector 200. The receptacle connector 100 further includes a pair of shielding plates 7 assemble within the island 12 to separate the two rows of contacts 2 in the transverse direction. In another embodiment, the pair of shielding plates 7 may be unitarily formed as one piece. The plug connector 200 further includes a shielding blade 8 assembled to the base 41 and extending into the mating cavity 42 to separate the two rows of terminals 5. During mating, the shielding blade 8 is sandwiched between the pair of shielding plates 7 so as to efficiently isolate the mated contacts 2 and terminals 5 on one side of the island 12 from those on the other side. In this embodiment, the island 12 includes a pair of retention slots 121, i.e., the first retention slot 1211 and the second retention slot 1212, and an insertion slot 122 communicatively between the pair of retention slots 121. The island 12 housing 1 further includes a top face 15 and a bottom face 16. The retention slots 121 extend from the bottom face 16 and terminates before reaching the top face 15 while the insertion slot 122 extends through both the top face 15 and the bottom face 16. The shielding plate 7 includes a retention section 71 retained in the retention slot 121 and a spring finger 72 extending into the insertion slot 122. The retention section 71 includes interference sides 710 engaged within the retention slot 121. The shielding plate 7 forms a mounting side and an insertion side opposite to each other, and includes the soldering legs 73 on the mounting side. The shielding plate 7 further includes an arcuate section 74 (i.e., an upside-down U-shaped structure) at the top opposite to the mounting side in the vertical direction and opposite to the spring fingers 72 in the transverse direction, One shielding plate 7 includes the first shielding part 711 includes a planar first retention section 7111 retained in the first retention slot 1211, and a first abutment section 7112 extending from the first retention section 7111 into the insertion slot 122. Similarly, the other shielding plate 7 includes a second shielding part 712 includes a planar second retention section 7121 retained in the second retention slot 1212, and a second abutment section 7122 extending from the second retention section 7121 into the insertion slot 122. Furthermore, as shown in FIGS. 3 and 7, the island 12 forms a plurality of passageways 123 beside the insertion slot 121 to protectively receive the corresponding spring fingers 72 therein. In addition, as shown in FIG. 7, the contacts 2 and the corresponding shielding plate 7 by the same side of the insertion slot are not overlapped with each other in the vertical direction but being spaced from each other in the transverse direction with a vertical wall 19 of the housing 1 therebetween for full separation.

During mating, the shielding blade 8 is inserted into the insertion slot 122 and sandwiched by the first abutment section 7112 of the first shielding part 711 and the second abutment section 7122 of the second shielding part 712 in the transverse direction. In this embodiment, the lengthwise dimension of the shielding plate 7 and the shielding blade 8 are similar to the dimension of the housing 1 and the casing 4, and during mating, the height of the connected shielding plate 7 and shielding blade 8 is similar to the assembled housing 1 and casing 4, thus assuring reliable shielding effect thereabouts.

Another feature of the invention is regarding the shield 3 having top frame structure to cover the top face of the housing 1, and the outer part 4 extends downwardly from four edges of the frame structure. The shell 6 is also configured as well.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical receptacle connector comprising:

an insulative housing including a horizontal base, an island and a peripheral wall commonly extending upwardly from the base in a vertical direction, the peripheral wall surrounding the island to form a tubular receiving cavity therebetween;

an insertion slot formed in the island and extending through a top face of the island;

a metallic shield retained to the housing and surrounding and covering the peripheral wall;

two rows of contacts retained in the housing with corresponding resilient contacting sections exposed upon two opposite sides of island and further into the receiving cavity in a transverse direction perpendicular to said vertical direction; and a pair of metallic shielding plates retained in the island and located by two opposite sides of the insertion slot in the transverse direction, wherein each of said shielding plates includes a spring finger extending into the insertion slot; and each of the shielding plates includes an upside-down U-shaped structure at a top thereof.

2. The electrical receptacle connector as claimed in claim 1, wherein the island forms a pair of retention slots by two sides of the insertion slot in the transverse direction to receive the pair of shielding plates, respectively.

3. The electrical receptacle connector as claimed in claim 1, wherein the shield includes a plurality of spring tangs extending into the receiving cavity opposite to the corresponding contacting sections in the transverse direction.

4. The electrical receptacle connector as claimed in claim 3, wherein the shield includes an outer part covering an exterior surface of the housing, and an inner part covering an interior surface of the housing facing toward the receiving cavity, and the spring tangs extend from the inner part.

5. The electrical receptacle connector as claimed in claim 4, wherein said spring tangs extend upwardly in compliance with the resilient contacting sections which extend upwardly.

6. An electrical connector assembly comprising:

a receptacle connector adapted to be mated with a plug connector, said receptacle connector including:

an insulative housing;

an insulative housing including a horizontal base, an island and a peripheral wall commonly extending upwardly from the base in a vertical direction, the peripheral wall surrounding the island to form a receiving cavity therebetween;

an insertion slot formed in the island and extending through a top face of the island;

a metallic shield retained to the housing and surrounding and covering the peripheral wall;

two rows of contacts retained in the housing with corresponding contacting sections exposed upon two opposite sides of island and further into the receiving cavity in a transverse direction perpendicular to said vertical direction;

a pair of metallic shielding plates retained in the island and located by two opposite sides of the insertion slot in the transverse direction; and said plug connector including:

an insulative casing including a base and a circumferential wall upwardly extending from the base in said vertical direction to commonly form a rectangular mating cavity therein;

a metallic shell enclosing the casing;

two rows of terminals retained to the casing with corresponding contacting portions exposed upon corresponding inner surfaces of two large side walls of the casing and facing toward the mating cavity and further toward each other in said transverse direction;

a metallic shielding blade retained to the casing and exposed in a center line of said mating cavity in the transverse direction; wherein during mating, the contacting sections of the contacts connect to the contacting portions of the terminals, the circumferential wall is received within the receiving cavity, the shielding blade is sandwiched between the pair of shielding plates, and spring fingers are formed on at least one of the shielding plate and the shielding blade to contact the other for mechanical and electrical connection therebetween; and each of the shielding plates includes an upside-down U-shaped structure at a top thereof.

7. The electrical connector assembly as claimed in claim 6, wherein the spring fingers are formed on the shielding plate.

8. The electrical connector assembly as claimed in claim 6, wherein said contacting sections are resilient and the contacting portions are stationary.

9. The electrical connector assembly as claimed in claim 8, wherein the shield includes an inner part to cover an interior surface of the housing, and spring tangs extend from the inner part into the receiving cavity in the transverse direction.

10. The electrical connector assembly as claimed in claim 9, wherein said spring tangs extend upwardly.

11. The electrical connector assembly as claimed in claim 10, wherein said spring fingers are formed on the shielding plate and extend upwardly.

12. An electrical connector assembly comprising:

an receptacle connector including:

an insulative housing including a horizontal base, an island and a peripheral wall commonly extending upwardly from the horizontal base in a vertical direction, the peripheral wall surrounding the island to form a tubular receiving cavity therebetween;

an insertion slot formed in the island and extending through a top face of the island;

a metallic shield retained to the housing and surrounding and covering the peripheral wall;

two rows of contacts retained in the housing with corresponding resilient contacting sections exposed upon two opposite sides of island and further into the receiving cavity in a transverse direction perpendicular to said vertical direction for contacting a corresponding terminal of a plug connector; and a pair of metallic shielding plates retained in the island and located by two opposite sides of the insertion slot in the transverse direction, wherein each of said shielding plates includes at least one spring finger extending into the insertion slot; wherein the shield includes an outer part covering an exterior surface of the housing, and an inner part covering an interior surface of the housing facing toward the receiving cavity, and a plurality of spring tangs extending from the inner part into the receiving cavity and communicatively and directly facing to and opposite to the corresponding contacting sections along the transverse direction in the receiving cavity.

13. The electrical connector assembly as claimed in claim 12, wherein the contacts and the corresponding shielding plate on a same side of the island are spaced from each other in the transverse direction without overlapping in the vertical direction but with therebetween a vertical wall of the housing which extends downwardly in the vertical direction from the top face of the housing to fully separate the contacts and the corresponding shielding plate in the transverse direction.

14. The electrical connector assembly as claimed in claim 12, wherein the island forms a pair of retention slots by two sides of the insertion slot in the transverse direction to receive the pair of shielding plates, respectively.

15. The electrical connector assembly as claimed in claim 12, wherein said spring tangs extend upwardly in compliance with the resilient contacting sections which extend upwardly.

16. The electrical connector assembly as claimed 12, wherein the island forms a plurality of passageways to protectively receive the corresponding spring fingers of said pair of metallic shielding plates therein.

17. The electrical connector assembly as claimed in claim 12, wherein said plug connector mated with the receptacle connector and including:

an insulative casing including a base and a circumferential wall upwardly extending from the base in said vertical direction to commonly form a rectangular mating cavity therein;

a metallic shell enclosing the casing;

two rows of said terminals retained to the casing with corresponding contacting portions exposed upon corresponding inner surfaces of two large side walls of the casing and facing toward the mating cavity and further toward each other in said transverse direction;

a metallic shielding blade retained to the casing and exposed in a center line of said mating cavity in the transverse direction; wherein during mating, the contacting sections of the contacts connect to the contacting portions of the terminals, the circumferential wall is received within the receiving cavity, the shielding blade is sandwiched between the pair of shielding plates, and said spring fingers abuts against the shielding blade for mechanical and electrical connection therebetween.

18. The electrical connector assembly as claimed in claim 17, wherein the metallic shell of the plug connector intimately abuts against the circumferential wall of the casing in the transverse direction.

* * * * *